United States Patent [19]

Newell et al.

[11] Patent Number: 4,488,423

[45] Date of Patent: Dec. 18, 1984

[54] STRAIGHTENING MACHINE

[75] Inventors: Burtram I. Newell, Thomaston; Reed Bertolette, Woodbury; Bruce C. Fogarty, Torrington, all of Conn.

[73] Assignee: Bertolette Machines, Inc., Torrington, Conn.

[21] Appl. No.: 499,411

[22] Filed: May 31, 1983

Related U.S. Application Data

[63] Continuation of Ser. No. 213,873, Dec. 8, 1980, abandoned.

[51] Int. Cl.[3] ..... B21D 1/00

[52] U.S. Cl. ..... 72/385; 72/399; 72/160; 72/164; 72/702

[58] Field of Search ..... 72/385, 164, 160, 147, 72/297, 305, 382, 396, 397, 399, 295, 296, 300, 702; 74/568 R

[56] References Cited

U.S. PATENT DOCUMENTS

| | | | |
|---|---|---|---|
| 221,102 | 10/1879 | Rowell | 72/385 |
| 443,463 | 12/1890 | Sechrist | 74/568 R |
| 774,377 | 11/1904 | Brinkman | 72/382 |
| 1,080,495 | 12/1913 | Steinbecker | 74/568 R |
| 1,414,371 | 5/1922 | Nilson | 72/164 |
| 1,493,502 | 5/1924 | Riegel | 72/370 |
| 1,890,039 | 12/1932 | Lange | 72/399 |
| 2,852,065 | 9/1958 | Peterson | 72/164 |
| 3,068,931 | 12/1962 | Clever | 72/164 |
| 3,328,995 | 7/1967 | Rohlfs | 72/297 |
| 3,525,247 | 8/1970 | Brauer et al. | 72/305 |
| 3,621,693 | 11/1971 | Adams | 72/164 |
| 3,736,787 | 6/1973 | Fencl et al. | 72/399 |
| 3,921,427 | 11/1975 | Malone et al. | 72/385 |
| 3,979,937 | 9/1976 | Semenenko et al. | 72/160 |
| 4,103,570 | 8/1978 | Rabinow | 72/385 |

FOREIGN PATENT DOCUMENTS

| | | | |
|---|---|---|---|
| 1812588 | 6/1970 | Fed. Rep. of Germany | 72/164 |

*Primary Examiner*—Daniel C. Crane

*Attorney, Agent, or Firm*—McCormick, Paulding & Huber

[57] ABSTRACT

A machine for straightening an elongated workpiece has a plurality of coacting tools which include first and second sets of tools arranged in alternate series along a fixed longitudinal axis to engage successive longitudinally spaced portions of a workpiece positioned therebetween with its longitudinal center line generally aligned with a longitudinal axis. A cam operated lever system simultaneously reciprocates the tools of the first and second sets in opposite transverse directions relative to the longitudinal axis and each other to alternately displace portions of the center line of the workpiece to one and the opposite side of the longitudinal axis. A mechanism is provided to vary the magnitude of reciprocating lever movement to vary center line displacement between a position of maximum displacement and a position wherein workpiece portions are substantially longitudinally aligned.

16 Claims, 4 Drawing Figures

STRAIGHTENING MACHINE

This is a continuation of application Ser. No. 213,873, filed Dec. 8, 1980, now abandoned.

BACKGROUND OF THE INVENTION

This invention relates in general to machines for straightening elongated workpieces and deals more particularly with an improved straightening machine of the type which straightens a workpiece by alternately displacing successive portions of the workpiece in one and opposite directions with a reciprocating motion. More particularly, the invention is concerned with improvements in a straightening machine of the type illustrated and described in U.S. Pat. No. 3,328,995 to Rohlfs, for VIBRATORY STRAIGHTENING MACHINES, assigned by mesne assignments to the assignee of the present invention. A machine of the aforesaid type utilizes a set of reciprocally movable workholders or tools which move in unison and in the same direction relative to a set of stationary tools to impart alternate bending movements to a workpiece to straighten it. Such machines as heretofore available are adapted to straighten relatively small elongated workpieces and have proven most satisfactory for this purpose. However, such machines are not particularly well adapted for straightening large workpieces such as heavy wrenches or the like. The larger tools and operating mechanism required to reciprocate the movable tools in unison introduce objectionable inertial and vibrational conditions. Further, the construction and arrangement of the tooling in a machine of the aforesaid type is such that the machine will accommodate workpieces in only a very limited range of sizes. The clearance between the tools or workholders and an associated workpiece is such that difficulty is often encountered in positioning a severely bent workpiece in the machine for straightening. It is often necessary to prestraighten a severely bent workpiece to enable it to be positioned in the machine for further straightening. The present invention is concerned with the aforedescribed problems.

SUMMARY OF THE INVENTION

In accordance with the present invention a machine for straightening elongated workpieces comprises at least three sets of coacting tools which include first and second sets of tools arranged in alternate series along a fixed longitudinal axis for engaging successive longitudinally spaced portions of a workpiece positioned in the machine with its longitudinal center line generally aligned with the longitudinal axis. Each set of tools includes two transversely opposed tools which have transversely spaced work engaging surfaces for engaging opposite sides of the workpiece. An operating means is provided for simultaneously reciprocating the tools of the first and second sets relative to the axis and in opposite direction relative to each other to alternately displace portions of the center line of the workpiece to one and the opposite side of the longitudinal axis with a vibratory motion. A means is provided for varying the magnitude of reciprocating movement to vary the amount of workpiece center line displacement between a position of maximum center line displacement and a position wherein the workpiece portions are substantially longitudinally aligned.

DETAILED DESCRIPTION OF PREFERRED EMBODIMENT

Figure 1:
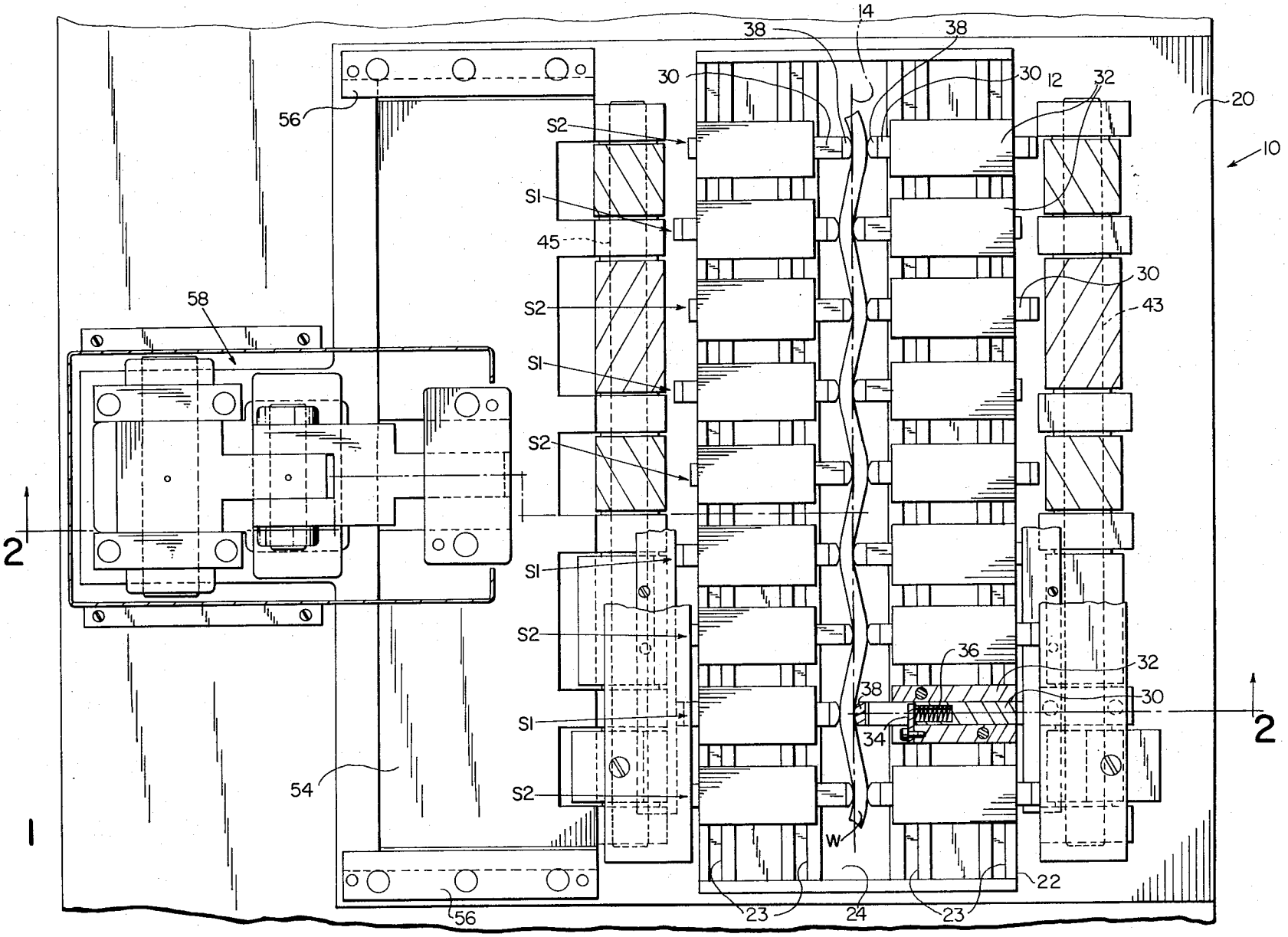
FIG. 1 is a fragmentary plan view of a straightening machine embodying the present invention.

Turning now to the drawings, a straightening machine embodying the present invention is indicated generally by the reference numeral 10. The machine 10 is particularly adapted to straighten an elongated workpiece, such as the workpiece W, shown in FIGS. 1 and 2, and has a tool assembly designated generally by the numeral 12 which indicates at least three sets of coacting tools arranged along a fixed longitudinal axis 14, shown in FIG. 1. The tools are arranged to engage successive longitudinally spaced portions or a workpiece W positioned in the machine with its longitudinal center line generally aligned with the longitudinal axis 14. An operating mechanism indicated generally at 16, and best shown in FIG. 2, simultaneously reciprocates all of the tools in transverse directions relative to the longitudinal axis 14 to alternately displace adjacent portions of the center line of the workpiece W to one and the opposite side of the axis 14. The operating mechanism 16 further includes an adjustable drive mechanism, indicated generally at 18, for varying the magnitude of the reciprocal movement of the tools whereby to vary the amount of center line displacement between a position of maximum center line displacement and a position wherein the workpiece portions are substantially longitudinally aligned. The alternate bending of the workpiece portions in one and opposite directions with decreasing motion causes the workpiece to assume a permanently straight set. The machine 10, which constitutes the presently preferred embodiment of the invention, is particularly adapted to straighten a workpiece with no substantialy endwise movement of the workpiece occuring during the straightening operation, however, it is not necessarily restricted to such application and may be adapted to permit axial passage of the workpiece during straightening.

Figure 4:
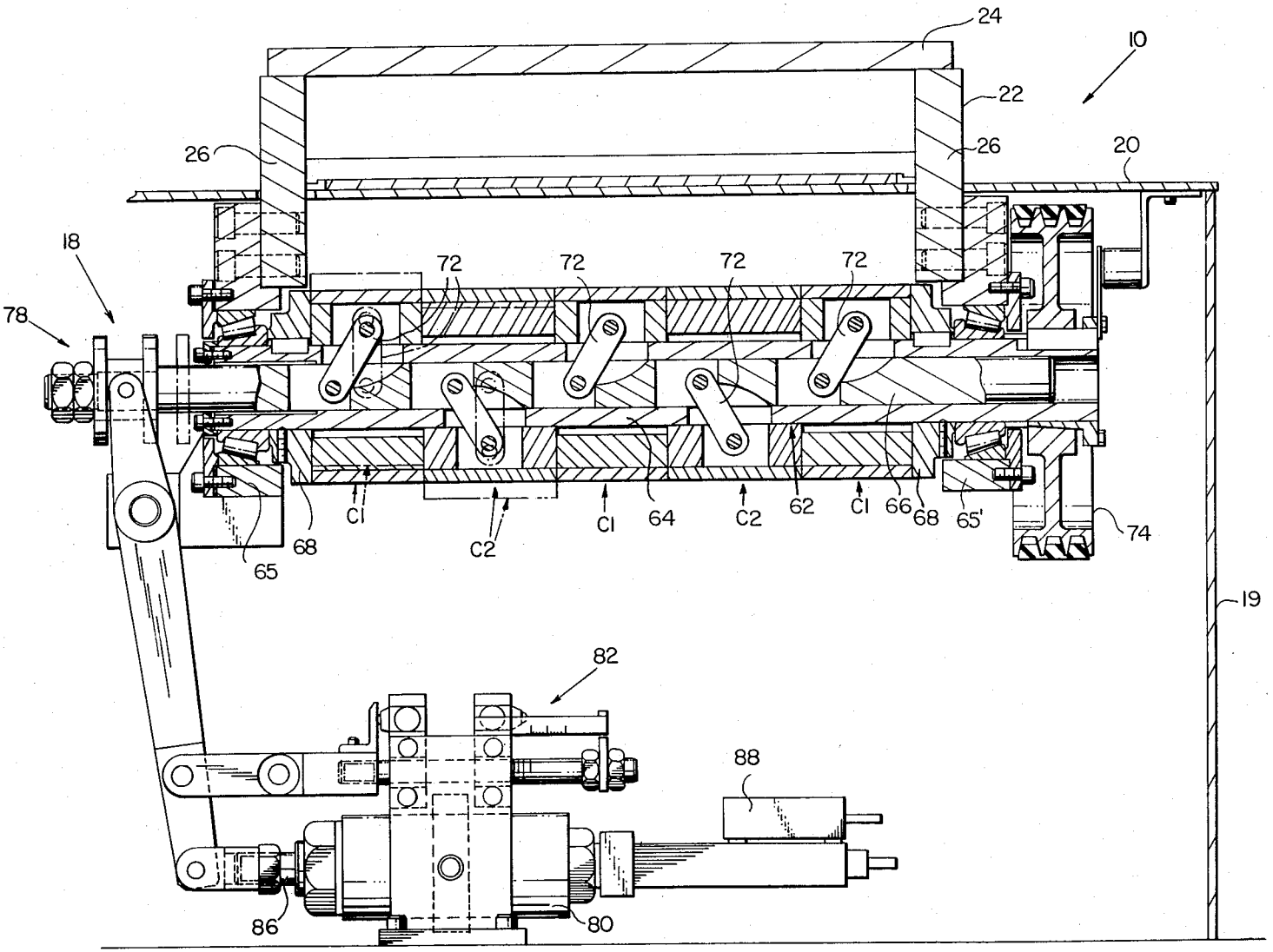
FIG. 4 is a fragmentary sectional view taken along the line 4—4 of FIG. 2.

Considering now the machine 10 in further detail, it has a base 19 which includes a generally horizontally disposed surface plate 20. The tool assembly 12 is supported on a tool frame 22 which comprises a weldment mounted on the surface plate 20. A horizontally disposed bed plate 24 which comprises part of the tool frame is spaced above the surface plate 20 and has parallel longitudinally extending and upwardly opening T-slots 23, 23 formed therein. The tool frame 22 further includes a pair of vertically disposed end plates 26, 26 which pass through the bed plate 20 and extend for some distance therebelow, as best shown in FIG. 4.

As previously noted, the machine of the present invention has at least three sets of tools, however, the number of sets of tools used in practicing the invention is optional and may be somewhat dependent upon the length of the elongated workpiece to be straightened, particularly where the straightening operating is to be performed with no substantial endwise movement of the workpiece. The illustrated machine 10 has nine substantially identical tool sets, however, for convenience in the further description which follows the tool sets are referred to as first and second tool sets, respectively designated at S1 and S2. The first sets S1, S1 are arranged in alternate series with the second sets S2, S2 along the axis 14, substantially as shown in FIG. 1.

Each set of tools includes two transversely opposed tools 30, 30. A typical tool 30 of a first set S1, shown in section in FIGS. 1 and 2, comprises a rectangular block supported for transverse sliding movement in a tool holder 32 which is secured to the tool frame 22 by T-bolts engaged within the T-slots 23, 23. A reaction plate 34 bolted to the tool holder 32, as best shown in FIG. 1, extends laterally into a slot in the tool 30 and provides a reaction surface for a coil spring 36 received in the slot. The coil spring acts between the plate 34 and the tool 30 to bias the tool in a transversely outward direction away from the longitudinal axis 14. The tool 30 has a hardened pad 38 fastened to its inner end which defines an arcuate work engaging surface, as viewed from above in FIG. 1. At its outer end illustrated tool 30 has an outwardly projecting upper portion which has another hardened pad 40 fastened to it. The tools 30, 30 which comprise the sets S2, S2 are substantially identical to the tool of the sets S1, S1 previously described, but are assembled in their respectively associated tool holders so that the pads 40, 40 are on the lower portions of the tools.

The operating mechanism 16 comprises a cam operated lever system which includes first and second groups of levers respectively generally indicated at L1 and L2. The levers of the first group L1 comprise opposing pairs of levers which include right-hand levers 42, 42 and left-hand levers 42', 42'. The right-hand levers 42, 42 are pivotally supported intermediate their ends on a shaft 43, which is journalled in fixed position on the surface plate 20. An elongated operating bar 44 connects the levers 42, 42 together at their upper ends to move in unison. The left-hand operating levers 42', 42' are supported to pivot on another shaft 45 which is supported for movement relative to the surface plate 20, as hereinafter described. The levers 42', 42' are connected together at their upper ends to move in unison by an elongated operating bar 44'. The opposing inner ends of the operating bars 44 and 44' are arcuately curved, as viewed in FIG. 2 and arranged for engagement with the pads 40, 40 on the tools of the first sets S1, S1.

The levers of the second group L2 comprise opposing pairs of right and left-hand levers respectively indicated at 46, 46 and 46', 46'. The right-hand levers 46, 46 are pivotally supported on and arranged along the shaft 43 in alternate series relative to the levers 42, 42, as shown in FIG. 3. An elongated operating bar 48 disposed below the operating bar 44 and inwardly of the levers 42, 42 connects the upper ends of the levers 46, 46 so that the latter levers pivot in unison. The left-hand levers 46', 46' are similarly arranged with respect to the levers 42', 42' along the movable shaft 45 and connected together by an elongated operating bar 48'. The inner ends of the operating bars 48, 48' are arcuately curved, as viewed in FIG. 2, to engage the pads 40, 40 on associated tools 30, 30 which comprise the second sets S2, S2. Follower rollers 50, 50 are journalled on the lower ends of each of the levers of the first and second groups L1 and L2, substantially as shown in FIGS. 2 and 3.

The movable shaft 45 is mounted on a plate 54 which is retained by guideways 56, 56, shown in FIG. 1, for limited sliding movement in transverse directions on the surface plate 20. A toggle linkage indicated generally at 58 and connected between the sliding plate 54 and the surface plate 20 is operated by a fluid motor or pneumatic cylinder 60 mounted below the surface plate 20 and shown in FIG. 2. the toggle linkage 58 is operable to move the lever shaft 45 and its associated left-hand levers 42', 42' and 46', 46' generally toward and away from the tool assembly 12.

The operating mechanism 16 further includes first and second groups of cams C1 and C2 for respectively operating the levers of said first and second groups L1 and L2. The cams C1 and C2 are mounted in alternate series along an elongated cam shaft assembly indicated generally at 62 which includes a tubular outer shaft 64 journalled on brackets 65, 65' mounted on the depending ends of the tool frame side plates 26, 26, as best shown in FIG. 4. The shaft assembly 62 further includes an inner shaft 66 coaxially received within the shaft 64 and supported for axial sliding movement within and relative to the shaft 64, as will be hereinafter discussed. The first and second groups of cams C1 and C2 are mounted on the cam shaft assembly 62 and restrained against axial movement relative to the cam shaft assembly by end collars 68, 68 secured to the tubular shaft 64 for rotation therewith. Each of the cams C1 and C2 has a radially elongated slot 70 which receives the shaft assembly 62 therethrough. A plurality of links 72, 72 connect the inner shaft 66 to the various cams C1 and C2, substantially as shown in FIG. 4. However, it will be noted that the links 72, 72 are connected in alternate series along the shaft to extend from diametrically opposite sides of the shaft 66. A drive pulley-flywheel 74 keyed to the hollow outer shaft 64 is connected to a drive motor 76 which rotates the cam shaft assembly 62. The shaft 66 is shifted axially relative to the shaft 64 by a shifting yoke mechanism indicated generally at 78 connected to one end of the shaft 66 and operated by a fluid motor 80. The fluid motor 80 is preferably of an air over hydraulic type which includes a reciprocally movable piston rod 86 which has a fast stroke in one direction and hydraulic means whereby the return stroke of the piston rod 86 may be adjusted through a substantially infinite range of return speeds. The yoke mechanism 78 is operable to alternately shift the rotating cams of the first and second groups C1 and C2 in opposite radial directions between positions of concentricity and eccentricity relative to the cam shaft assembly 62. Tension springs 82, 82 (one shown in FIG. 2) connected between opposing pairs of levers of the first and second groups L1 and L2 maintain the folllower rollers 50, 50 in engagement with respectively associated cams C1 and C2.

Figure 2:
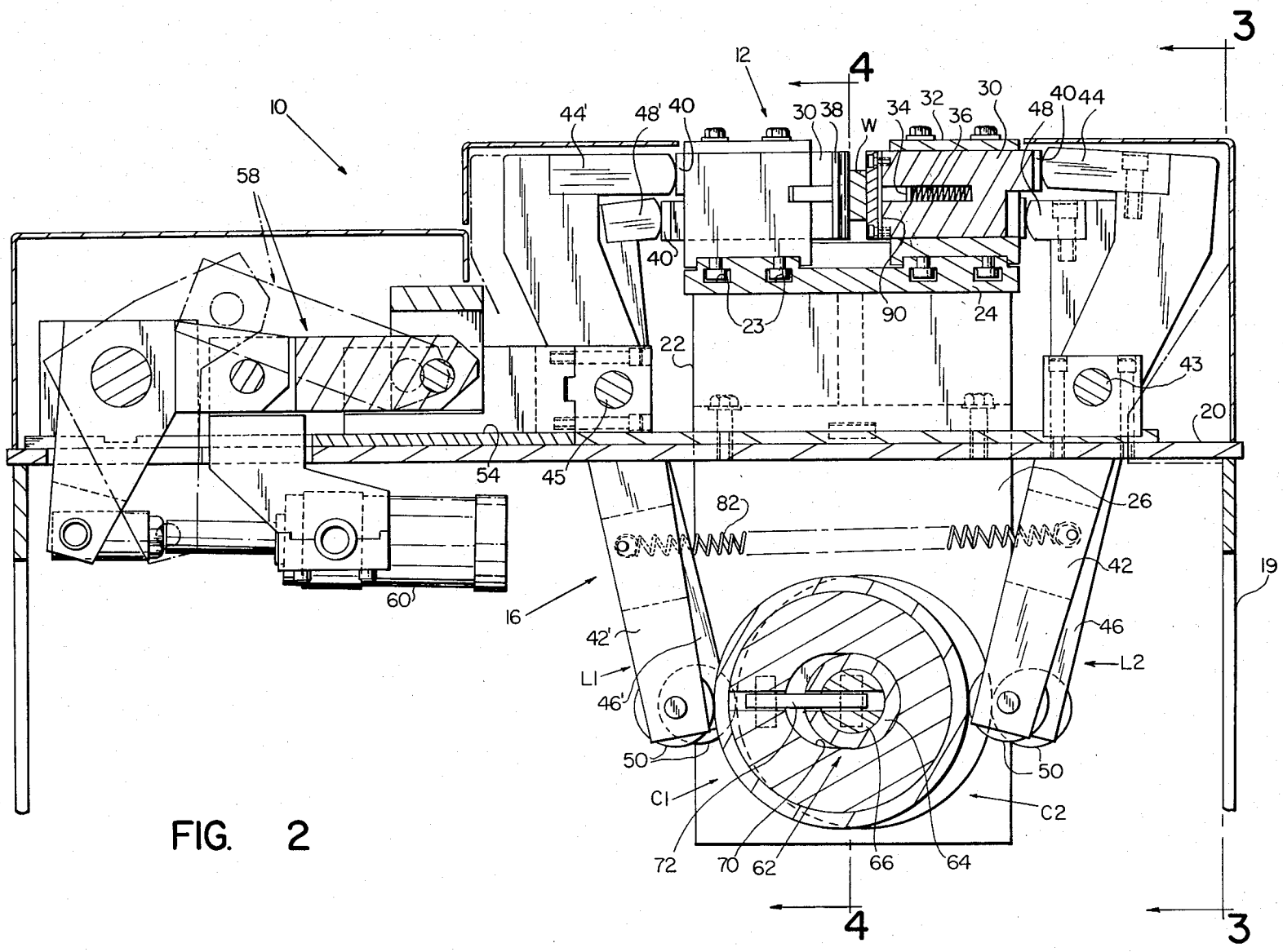
FIG. 2 is a fragmentary sectional view taken along line 2—2 of FIG. 1.
Figure 3:
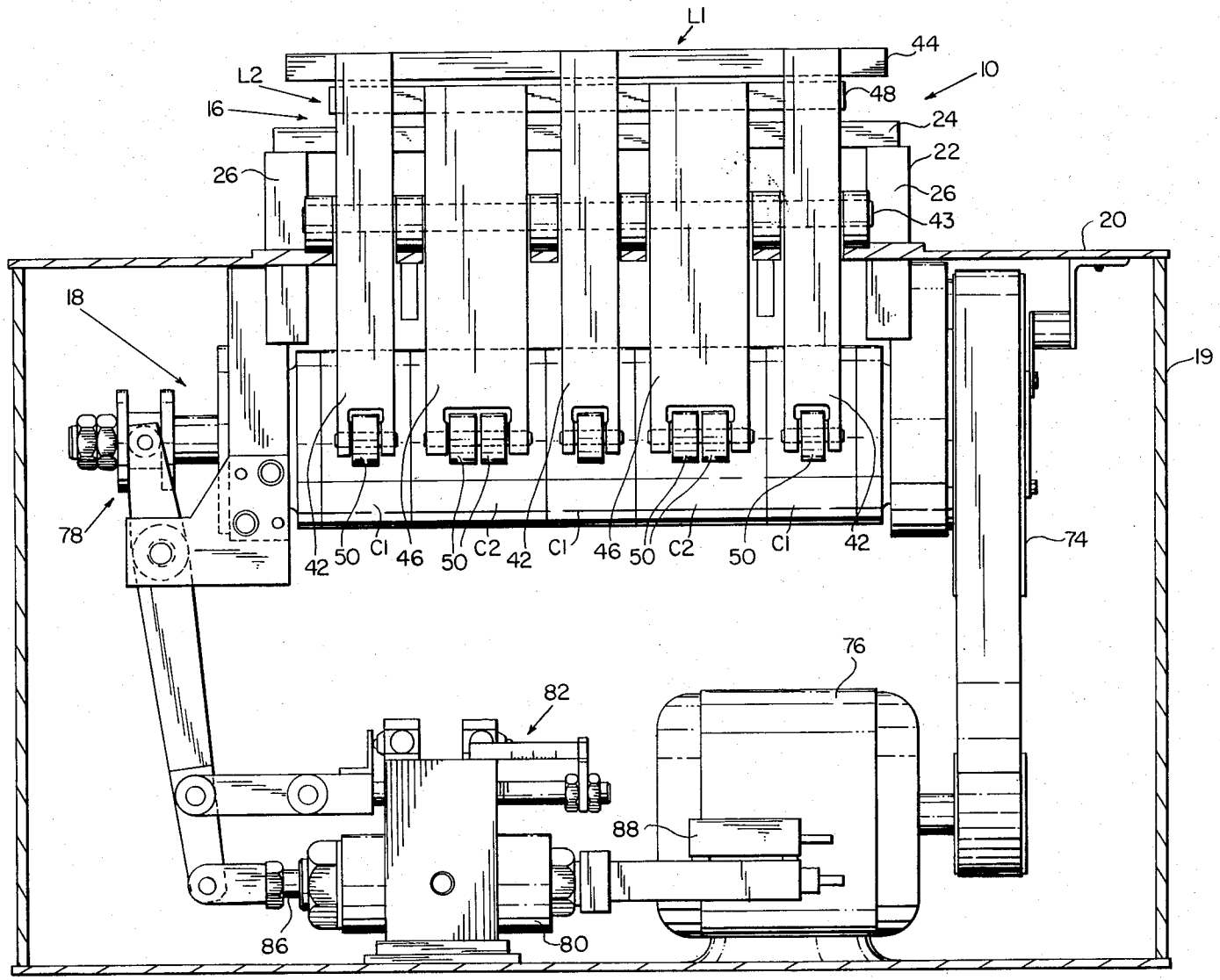
FIG. 3 is a fragmentary sectional view taken along the line 3—3 of FIG. 2.

At the beginning of the operating cycle the toggle lever 58 is normally in its open or broken line position of FIG. 2. The drive motor 76 is idling and the cams of the first and second groups C1 and C2 are in concentric alignment with the cam shaft assembly 62 so that the levers of the first and second groups L1 and L2 are at rest. Each tool 30 is biased outwardly within its holder 32 and away from the axis 14 by its associated biasing spring 36. Thus, the tools which comprise the tool assembly 12 are in open position ad will allow even a severely bent workpiece W to be positioned therebetween.

Upon initiation of the operating cycle the fluid motor 60 first operates to close the toggle linkage 58 whereby to move the lever shaft 45 and the left-hand levers 42', 42' and 46', 46' toward the tool assembly 12 to close the tools 30, 30 or reduce the spacing therebetween. After the tools have been closed the fluid motor 80 operates to shift the inner shaft 66 axially relative to the outer shaft 64 whereby to rapidly move the rotating cams of the first and second groups C1 and C2 in radially opposite directions to positions of maximum eccentricity relative to the cam shaft assembly 62. An adjustable stop mechanism indicated generally at 82 in FIGS. 3 and 4 and associated with the fluid motor 80 may be adjusted to control the length of the stroke of the reciprocally movable piston rod 86 whereby to adjust the shifting movement of the yoke mechanism 78 and the resulting eccentricity of the cams C1 and C2. The cams C1 and C2 cause the respectively associated levers of the first and second L1 and L2 to alternately rock in opposite directions about their respective axes whereby to move the tools of the first and second sets S1, S1 and S2, S2 in transversely opposite directions to produce maximum overbending of alternately adjacent portions of a workpiece W. This overbending causes the workpiece to assume generally serpentine shapes, as viewed from above, and as shown in FIG. 1, as successive portions of the workpiece center line are bent first to one and then to the opposite side of the longitudinal axis 14. The fluid motor 80 preferably operates to cause this initial overbending condition to occur rapidly as the piston rod 86 moves to the limit of its stroke, as determined by adjustment of the stop mechanism 82. The return stroke of the piston rod 86 is preferably controlled to provide slow return of the cams C1, C2 from positions of maximum eccentricity to positions of concentricity relative to the shaft assembly 62. In this manner the rocking motion of the levers of the first and second groups L1 and L2 is slowly decreased whereby to gradually decrease the reciprocating motion imparted by the lever system to the tools of the first and second sets S1 and S2. When the cams C1 and C2 return to positions of concentricity with respect to the shaft assembly 62 the workpiece portions are substantially aligned and take a substantially straight set.

The machine 10 preferably includes mechanism for ascertaining that the cams C1 and C2 move the levers of the first and second groups L1 and L2 to positions corresponding to maximum overbending conditions of the workpiece, as determined by adjustment of the stop mechanism 82, before commencement of the controlled return stroke of the piston rod 86. Suitable timing mechanism such as a timer indicated at 88 in FIGS. 3 and 4 may be provided to ascertain that the shaft assembly 62 completes at least one full revolution with the cams C1 and C2 in positions of maximum eccentricity before commencement of the return stroke of the piston rod 86.

Preferably the machine of the present invention also includes shims associated with the tools 30, 30 for varying the spacing between the transversely opposed work engaging surfaces of the tools. A typical shim is indicated by the numeral 90 in FIG. 2. Alternatively, an adjustable arrangement may be provided for anchoring the toggle mechanism 58 to the surface plate 20, as, for example, slots in the plate 20 for receiving the fasteners which secure the toggle mechanism to the plate 20. When the latter arrangement is employed, the spacing between all of the various working engaging surfaces may be simultaneously changed by adjusting the position of the toggle mechanism 58 relative to the surface plate 20.

We claim:

1. A machine for straightening an elongated workpiece comprising at least three sets of coacting tools including first and second sets of tools arranged in alternate series along a fixed longitudinal axis to engage successive longitudinally space portions of a workpiece positioned in said machine with its longitudinal center line generally aligned with said longitudinal axis, each of said sets including two transversely opposed tools having transversely spaced work engaging surfaces engageable with transversely opposite sides of the workpiece when said tools are in working position, operating means for simultaneously reciprocating said first and second sets of tools a plurality of times within a working cycle and in opposite transverse directions relative to said longitudinal axis and each other to alternately displace portions of the center line of the workpiece to one and the opposite side of said longitudinal axis, means for varying the magnitude of said reciprocating movement to vary the magnitude of center line displacement between a position of maximum center line displacement and a position wherein the workpiece portions are substantially longitudinally aligned, and means for simultaneously moving said tools of each of said sets in unison relative to and away from each other from said working position to a workpiece receiving position, said tools of each of said sets being normally maintained in said working position by said operating means.

2. A machine for straightening an elongated workpiece as set forth in claim 1 including means for biasing said tools of each of said sets in directions away from each other and from said longitudinal axis.

3. A machine for straightening an elongated workpiece as set forth in either claim 1 or claim 2 including means for moving said operating means to allow said tools to move to said workpiece receiving position.

4. A machine for straightening an elongated workpiece as set forth in claim 3 wherein said operating means comprises a lever system and said means for moving said operating means comprises means for moving fulcrums of said lever system.

5. A machine for straightening elongated workpieces as set forth in claim 4 wherein said means for moving said operating means comprises a toggle mechanism.

6. A machine for straightening an elongated workpiece as set forth in claim 5 wherein said means includes a motor for operating said toggle mechanism.

7. A machine for straightening an elongated workpiece as set forth in claim 1 wherein said operating means comprises a lever system including first and second groups of levers for respectively moving said first and second sets of tools.

8. A machine for straightening an elongated workpiece as set forth in claim 7 wherein said operating means comprises first and second groups of cams for respectively operating said first and second groups of levers.

9. A machine for straightening elongated workpieces as set forth in claim 8 wherein said cams comprise rotary cylindrical cams and said means for varying the magnitude of reciprocating movement comprises means for moving said cams between concentric and eccentric positions relative to an axis of rotation.

10. A machine for straightening an elongated workpiece comprising at least three sets of coacting tools including first and second sets of tools arranged in adjacent alternate series along a fixed longitudinal axis to engage successive longitudinally spaced portions of a workpiece positioned in said machine with its longitudinal center line aligned in generally parallel relation with said longitudinal axis, each of said sets including two transversely aligned tools having directly opposed and transversely spaced apart work engaging surfaces engageable with transversely opposite side portions of the workpiece, operating means for simultaneously reciprocating said first and second sets of tools a plurality of times within a working cycle and in opposite transverse directions relative to said longitudinal axis and each other and along parallel rectilinear paths to alternately displace portions of the center line of the workpiece to one and the opposite side of said longitudinal axis and including a lever system having first and second groups of levers for respectively engaging and moving said first and second sets of tools and parallel longitudinally extending lever shafts supported at opposite sides of said fixed longitudinal axis for pivotally supporting said first and second groups of levers, means for varying the magnitude of said reciprocating movement of said tools to vary the magnitude of center line displacement between a position of maximum center line displacement and a position wherein the workpiece portions are substantially longitudinally aligned and means for moving one of said lever shafts generally toward and away from the other of said lever shafts to respectively simultaneously decrease and increase the transverse spacing between said work engaging surfaces of all of said tools.

11. A machine for straightening an elongated workpiece comprising at least three sets of coacting tools including first and second sets of tools arranged in alternate series along a fixed longitudinal axis to engage successive longitudinally spaced portions of a workpiece positioned in said machine with its longitudinal center line generally aligned with said longitudinal axis, each of said sets including two transversely opposed tools having tansversely spaced work engaging surfaces engageable with transversely opposite sides of the workpiece, operating means including a lever system for simultaneously reciprocating said first and second sets of tools a plurality of times within a working cycle and in opposite transverse directions relative to said longitudinal axis and each other to alternately displace portions of the center line of the workpiece to one and the opposite side of said longitudinal axis, said lever system including first and second groups of levers for respectively moving said first and second sets of tools and first and second groups of cylindrical cams for respectively operating said first and second groups of levers, and means for moving said cams between concentric and eccentric positions relative to an axis of rotation to vary the magnitude of center line displacement between a position of maximum center line displacement and a position wherein the workpiece portions are substantially longitudinally aligned.

12. A machine for straightening an elongated workpiece as set forth in claim 11 wherein said means for moving said cams is further characterized as means for simultaneously moving said first and second groups of cams in radially opposite directions between said concentric and eccentric positions.

13. A machine for straightening an elongated workpiece as set forth in either claim 9 or claim 12 wherein said means for moving said cams comprises a shaft supporting said cams for rotation and supported for axial shifting movement relative to said cams and link means drivingly connecting said cams to said shaft.

14. A machine for straightening an elongated workpiece as set forth in claim 13 wherein said means for moving said cams includes a motor for axially shifting said shaft.

15. A machine for straightening an elongated workpiece as set forth in claim 14 wherein said means for moving said cams includes means for varying the axial shifting movement of said shaft in response to the operation of said motor.

16. A machine for straightening an elongated workpiece comprising at least three sets of coacting tools including first and second sets of tools, attaching means releasably securing said sets of tools in alternate series along a fixed longitudinal axis for varying the longitudinal spacing between adjacent sets of tools, said sets of tools being engageable with successive longitudinally spaced portions of a workpiece positioned in said machine with its longitudinal center line generally aligned with said longitudinal axis, each of said sets including two transversely opposed tools having transversely spaced work engaging surfaces engageable with transversely opposite sides of the workpiece when said tools are in working position, operating means for simultaneously reciprocating said first and second sets of tools, a plurality of times within a working cycle and in opposite transverse directions relative to said longitudinal axis and each other to alternately displace portions of the center line of the workpiece to one and the opposite side of said longitudinal axis, means for varying the magnitude of said reciprocating movement to vary the magnitude of center line displacement between a position of maximum center line displacement and a position wherein the workpiece portions are substantially longitudinally aligned, and means for simultaneously moving said tools of each of said sets in unison relative to and away from each other from said working position to a workpiece receiving position, said tools of each of said sets being normally maintained in said working position by said operating means.